US009394736B2

(12) United States Patent
Simon

(10) Patent No.: US 9,394,736 B2
(45) Date of Patent: Jul. 19, 2016

(54) DOOR CLOSER MECHANISM FOR DISPLAY CASE

(71) Applicant: Zero Zone, Inc., North Prairie, WI (US)
(72) Inventor: Paul Simon, Waukesha, WI (US)
(73) Assignee: Zero Zone, Inc., North Prairie, WI (US)

( * ) Notice: Subject to any disclaimer, the term of this patent is extended or adjusted under 35 U.S.C. 154(b) by 59 days.
(21) Appl. No.: 14/173,351
(22) Filed: Feb. 5, 2014
(65) Prior Publication Data
US 2015/0218864 A1 Aug. 6, 2015
(51) Int. Cl.
*E05F 1/08* (2006.01)
*E05F 1/12* (2006.01)
*E05D 7/081* (2006.01)
(52) U.S. Cl.
CPC ..... *E05F 1/1215* (2013.01); *E05D 7/081* (2013.01); *E05Y 2201/492* (2013.01); *E05Y 2201/704* (2013.01); *E05Y 2900/202* (2013.01); *Y10T 16/5402* (2015.01)
(58) Field of Classification Search
CPC ..... Y10T 16/304; Y10T 16/2771; Y10T 16/5386; Y10T 16/53862; Y10T 16/538627; Y10T 16/538633; Y10T 16/53888; Y10T 16/5389; E05F 3/20; E05F 1/12; E05F 1/1223; E05F 1/1008; E05F 1/1025; E05F 1/1207; E05F 1/1215; E05F 1/14; E05Y 2201/21; E05Y 2201/25; E05Y 2201/484; E05Y 2201/492; E05Y 2201/496; E05Y 2201/702; E05Y 2201/704; E05Y 2201/71; E05Y 2900/20; E05Y 2900/202; E05Y 2900/30
See application file for complete search history.

(56) References Cited

U.S. PATENT DOCUMENTS 2,072,094 A * 3/1937 Bommer ..... E05F 3/20 16/299
2,629,881 A * 2/1953 Young ..... A47K 13/12 16/298
4,073,038 A * 2/1978 Curry ..... E05F 1/1215 16/301
4,696,078 A 9/1987 Stromquist
4,780,914 A * 11/1988 Lin ..... A47K 13/10 16/298
4,817,242 A * 4/1989 Rapp ..... A47K 13/12 16/300
5,419,640 A * 5/1995 Doring ..... E05D 5/12 384/255
8,966,713 B1 * 3/2015 Russo ..... E05F 1/10 16/285
2003/0051313 A1 * 3/2003 Wu ..... E05F 1/1215 16/298
2007/0000090 A1 * 1/2007 Wu ..... E05D 11/0054 16/299
2007/0113378 A1 * 5/2007 Talpe ..... E05F 1/1215 16/298
2011/0069406 A1 * 3/2011 Hwang ..... B60R 1/074 359/841
2011/0214354 A1 * 9/2011 Talpe ..... F16F 9/19 49/324
2011/0239406 A1 * 10/2011 Macernis ..... E05F 1/1215 16/354
2012/0005861 A1 * 1/2012 Homner ..... E05F 1/1215 16/308
2014/0132141 A1 * 5/2014 Sun ..... E05D 7/0027 312/404

FOREIGN PATENT DOCUMENTS

EP 1635367 A1 * 3/2006 ..... H01H 3/162

* cited by examiner

*Primary Examiner* — Chuck Mah
(74) *Attorney, Agent, or Firm* — Michael Best & Friedrich LLP

(57) ABSTRACT

A display case includes a housing partially surrounding a display space, a door pivotably coupled to the housing and cooperating with the housing to further enclose the display space, and a hinge assembly for pivotably coupling the door to the housing. The hinge assembly includes a biasing member applying a biasing force on the door and a gear drive for adjusting a pre-tension force on the biasing member.

18 Claims, 7 Drawing Sheets

DOOR CLOSER MECHANISM FOR DISPLAY CASE

BACKGROUND

The present invention relates to display cases and, more particularly, to a door closer mechanism for a refrigeration display case.

Refrigeration cases circulate air through a refrigeration coil to keep the contents cool and include a door to allow a user to access the contents. The door is at least partially transparent to display the contents. The door is biased toward a closed position to provide insulation of the refrigerated interior compartment when a user is not accessing the interior compartment.

SUMMARY

In one embodiment, the invention provides a display case including a housing partially surrounding a display space, a door pivotably coupled to the housing and cooperating with the housing to further enclose the display space, and a hinge assembly for pivotably coupling the door to the housing. The hinge assembly includes a biasing member applying a biasing force on the door and a gear drive for adjusting a pre-tension force on the biasing member.

In another embodiment, the invention provides a display case including a main housing, a support member, a second housing having a first gear, a second gear, a door pin defining a door axis, a biasing member, and a door coupled to the door pin for co-rotation therewith. The main housing partially encloses a display space and defines an opening. The support member is fixedly coupled to the main housing. The second housing is coupled to the support member. The second gear is supported for rotation by the support member and is in meshing relationship with the first gear. Rotation of the second gear produces a corresponding rotation of the first gear and the second housing. The door pin is supported for rotation about the door axis by the second housing. The biasing member is connected to the door pin and the second housing and operable to provide a biasing force to the door pin. The biasing force is adjusted in response to the rotation of the second housing. The biasing force biases the door toward a closed position.

In yet another embodiment, the invention provides a hinge assembly for a door of a display case. The hinge assembly includes a pin for supporting the door, a shell, a spring coupled between the pin and the shell, a first gear secured to the shell, and a second gear engaging the first gear. The pin defines a pivot axis. The shell includes a bore receiving at least a portion of the pin, and the shell is movable relative to the pin. The spring exerts a biasing force on the pin about the pivot axis. Rotation of the second gear causes the shell to pivot relative to the pin, thereby changing the biasing force exerted by the spring member.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," and "having" and variations thereof herein is meant to encompass the items listed thereafter and equivalents thereof as well as additional items.

DETAILED DESCRIPTION

Figure 1:
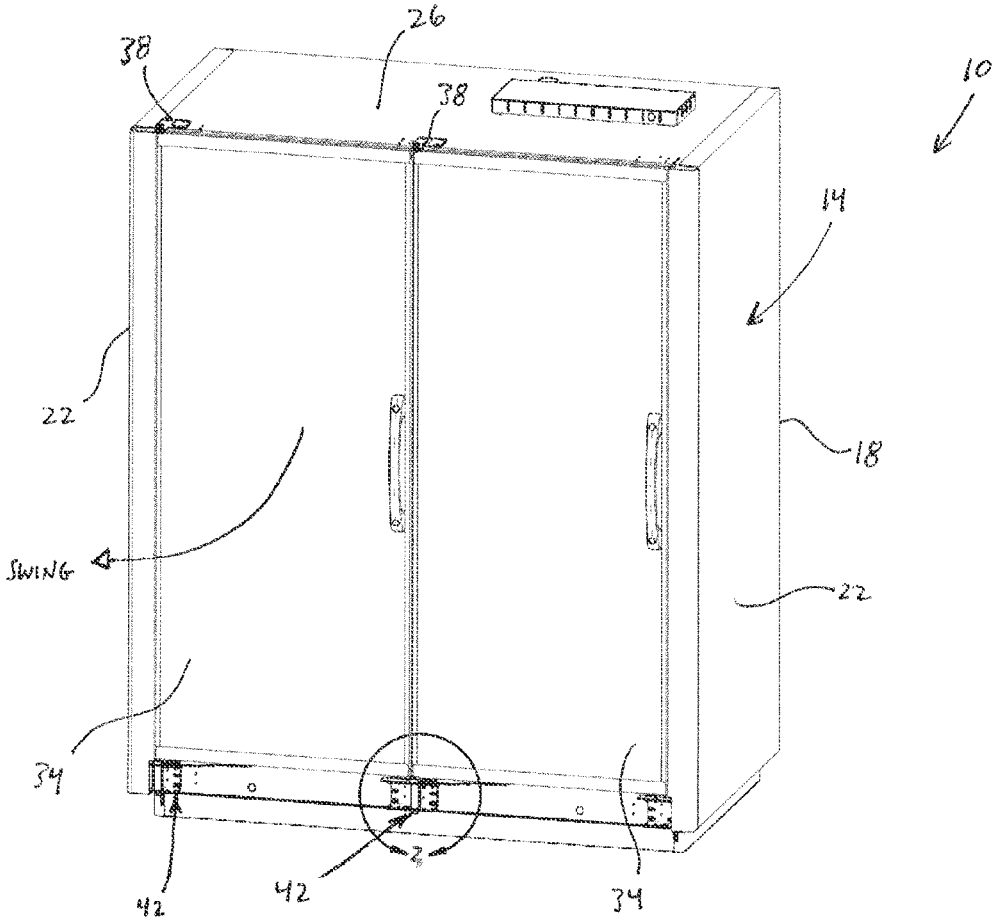
FIG. 1 is a perspective view of a refrigeration case.
Figure 2:
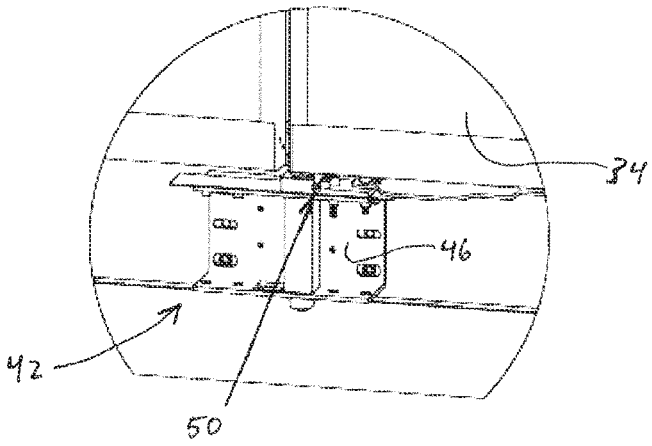
FIG. 2 is an enlarged perspective view of a portion of the case of FIG. 1.
Figure 3:
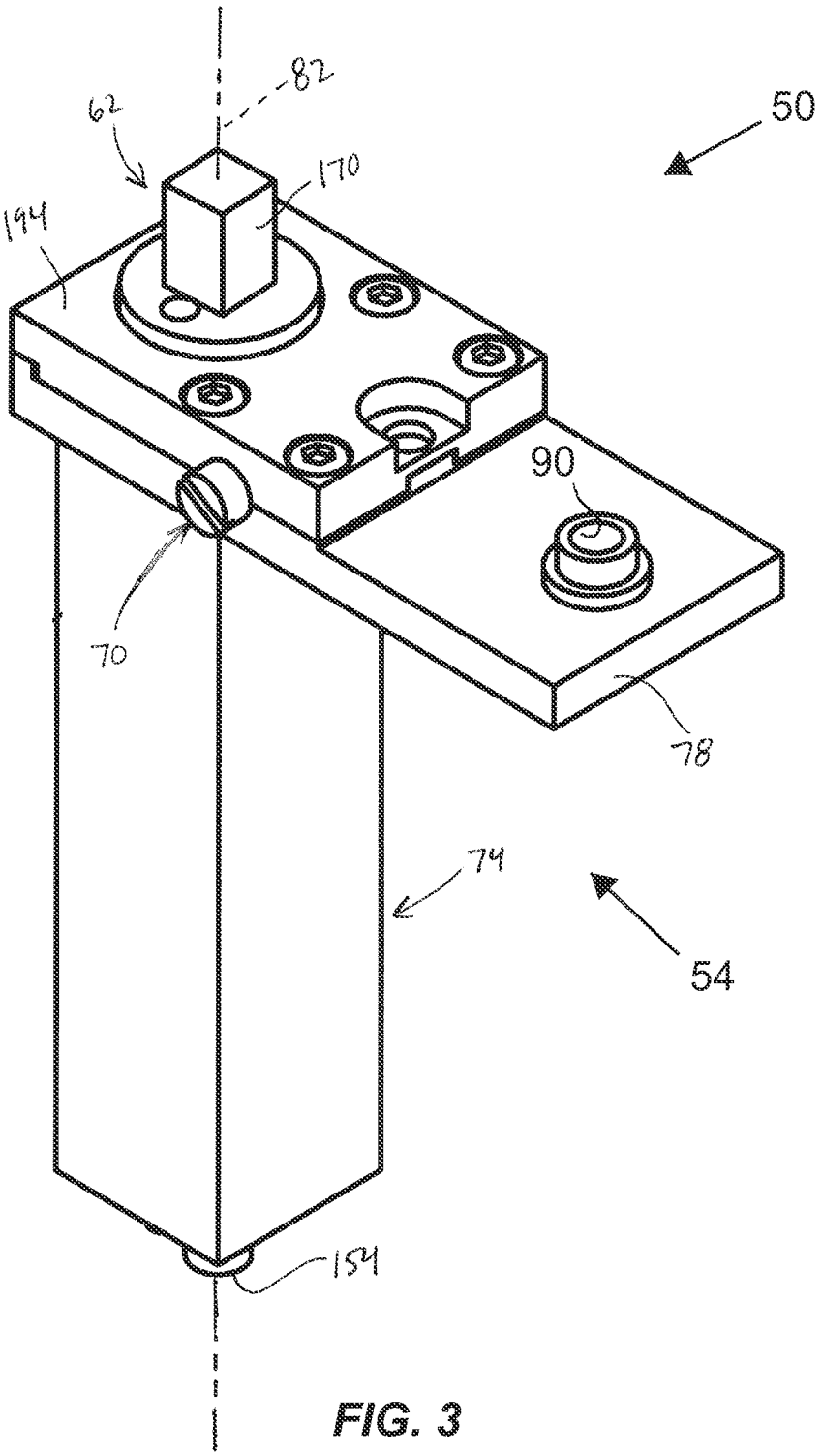
FIG. 3 is a perspective view of a hinge assembly.
Figure 4:
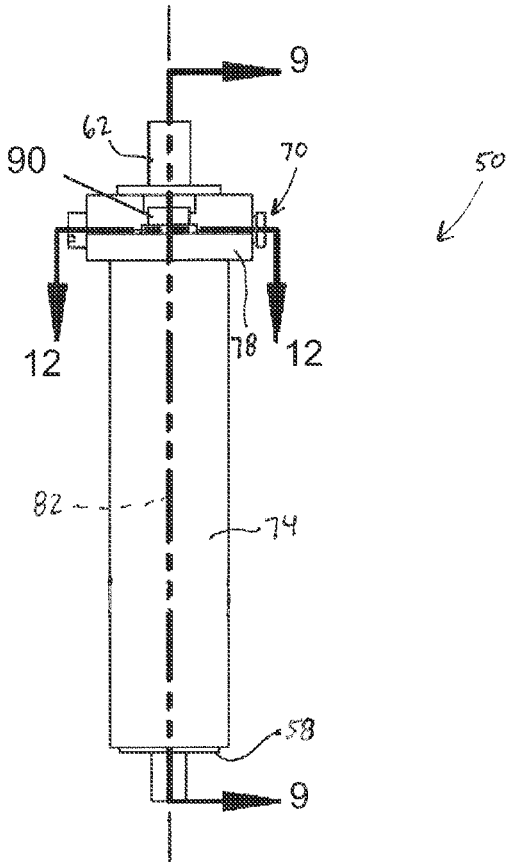
FIG. 4 is a side view of the hinge assembly of FIG. 3.

FIG. 1 shows a display case 10 including a housing 14 defined by a rear wall 18, a pair of side walls 22, a top 26, and a bottom 30. The case 10 also includes a pair of doors 34 that swing open to provide access to the contents of the housing 10. Each door 34 pivots about an upper hinge 38 and a lower hinge 42. In other embodiments, the case 10 may include fewer or more doors 34. FIG. 2 illustrates that the lower hinge 42 includes a bracket 46 supporting a door closer mechanism 50. The two doors 34 of the display case 10 are hinged on the same side so that both doors 34 open toward the left. Other constructions may reverse this so that the doors both open to the right. Because the doors 34 open in the same direction, the hinges 42 cannot be positioned on the outside of the housing 14 as would be possible with two doors that open in opposite directions (i.e., doors that open outwardly from the center toward the side walls 22).

As shown in FIGS. 3-6, the door closer mechanism 50 includes a support member or cartridge 54, an inner housing or elongated shell 58 (FIGS. 4-6), a hinge pin 62, a biasing or spring member 66 (FIG. 5), and a gear shaft 70. The cartridge 54 includes an outer housing or elongated sleeve 74 and a flange 78 positioned on one end of the sleeve 74. The sleeve 74 defines a longitudinal axis 82, and a bore 86 (FIG. 6) extends along the axis 82 through the sleeve 74. The flange 78 extends perpendicularly with respect to the axis 82 and includes lugs 90 for mounting the door closer mechanism 50 to the bracket 46 (FIG. 2). The flange 78 also includes a groove 94 (FIGS. 5 and 6) for supporting the gear shaft 70. In other embodiments, the cartridge may be formed simply as a flange (i.e., without the elongated sleeve 74), wherein the flange is coupled to the bracket 46 and includes a portion supporting the shell 58 and a portion supporting the gear shaft 70.

Figure 6:
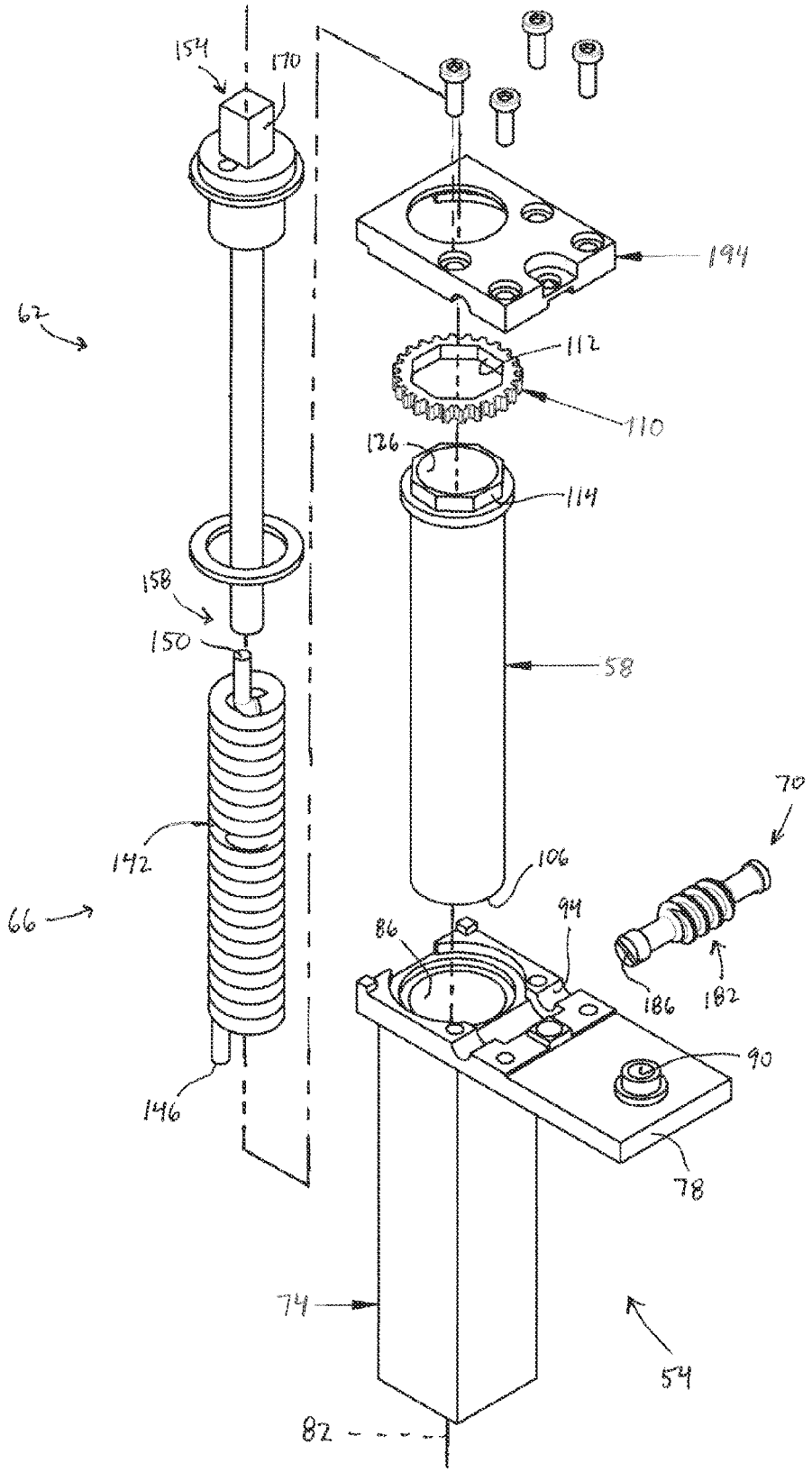
FIG. 6 is an exploded view of the hinge assembly of FIG. 3.

Referring to FIG. 6, the shell 58 is received within the bore 86 of the sleeve 74 and is aligned with the axis 82 of the sleeve 74. The shell 58 includes a first end 102 and a second end 106. A ring gear 110 is coupled to the first end 102 of the shell 58. In the illustrated embodiment, an internal faceted surface 112 of the ring gear 110 engages an external faceted surface 114 of the shell 58 proximate the first end 102 to rotatably secure the ring gear 110 with respect to the shell 58. In addition, a lip 118 is positioned on the shell 58 proximate the first end 102 to support the shell 58 for rotation with respect to the sleeve 74.

Figure 7:
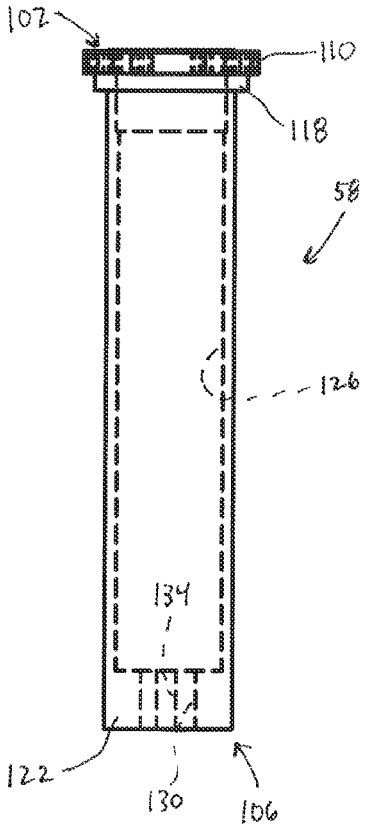
FIG. 7 is a side view of a shell.
Figure 8:
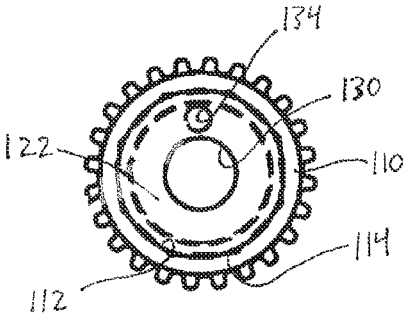
FIG. 8 is a top view of the shell of FIG. 7.

As best shown in FIGS. 7 and 8, the second end 106 of the shell 58 defines an end wall 122, and a shell bore 126 extends from the first end 102 of the shell 58 to the end wall 122. The end wall 122 includes an opening 130 in communication with the shell bore 126. The end wall 122 also includes a first spring coupling 134. In the illustrated embodiment, the first spring coupling 134 is a hole formed in the end wall.

Referring again to FIG. 6, the spring member 66 is positioned within the shell 58 and aligned with the longitudinal axis 82 such that the spring member 66 exerts a biasing force about the axis 82. In the illustrated embodiment, the spring member 66 is a torsional coil spring 142 having a first end 146 secured to the shell 58 at the first spring coupling 134 and a second end 150 secured to the hinge pin 62 as described below. The spring member 66 exerts a force on the hinge pin 62 in order to bias the door 34 toward the closed position.

Figure 9:
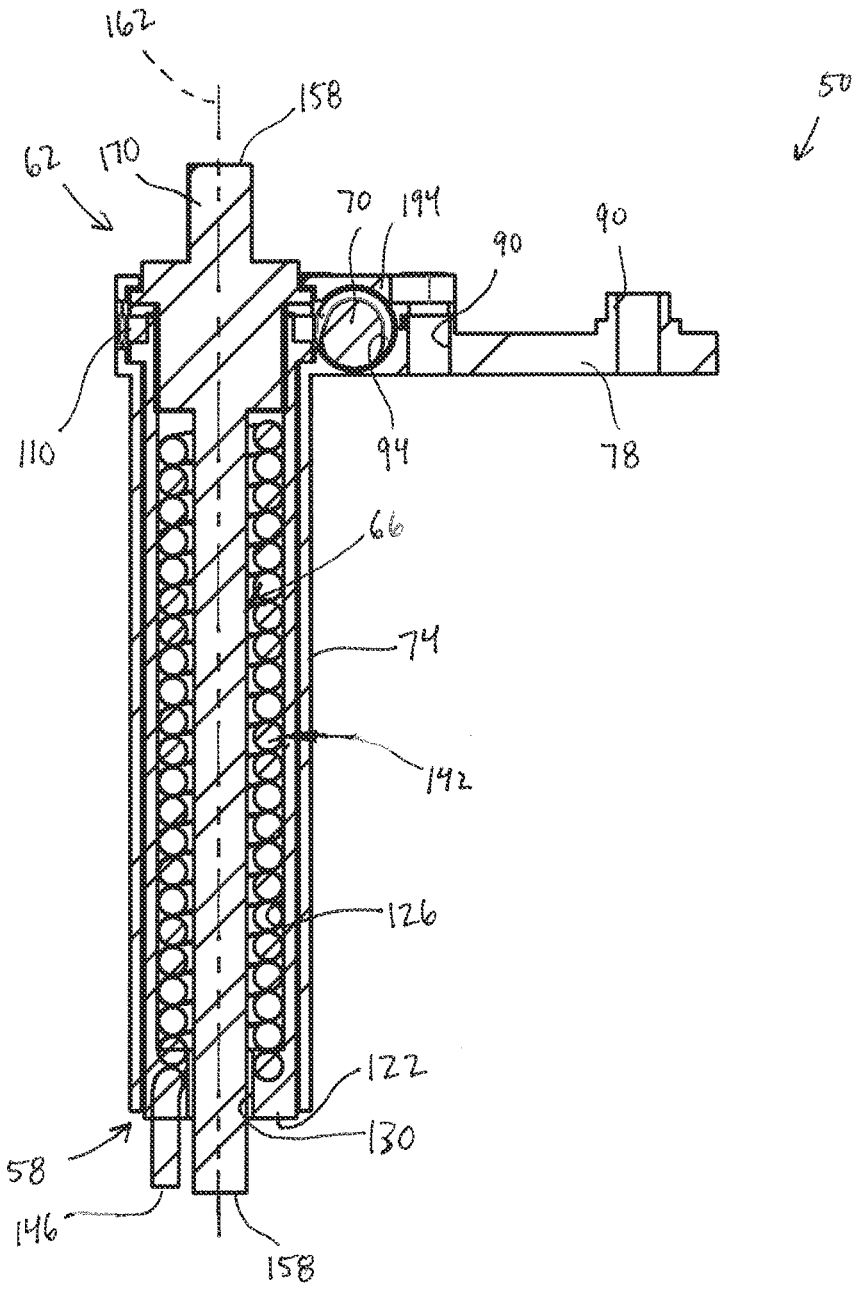
FIG. 9 is a section view of the hinge assembly of FIG. 4, taken along section 9-9.

FIG. 9 shows the hinge pin 62 supported for rotation relative to the shell 58 such that a portion of the pin 62 is positioned within the shell bore 126. In the illustrated embodiment, the hinge pin 62 passes through the center of the coil spring 142 and is supported by a washer made from, for example, plastic. In some embodiments, a retainer may be coupled to the second end 158 of the pin 62 to limit movement of the hinge pin 62 parallel to the axis 82 from the second end 106 of the shell 58 toward the first end 102. The hinge pin 62 includes a first end 154 extending above the shell 58 and a second end 158 extending through the opening 130 in the end wall 122.

Figure 10:
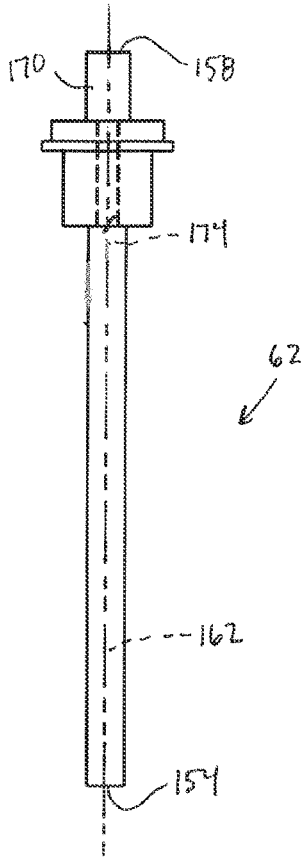
FIG. 10 is a side view of a hinge pin.
Figure 11:
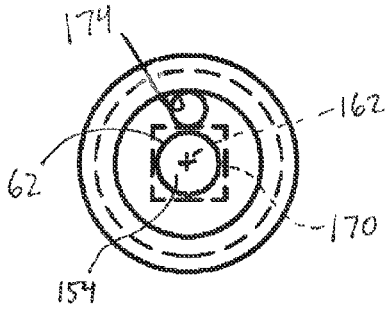
FIG. 11 is a bottom view of the hinge pin of FIG. 10.

As best shown in FIGS. 10 and 11, the hinge pin 62 defines a pivot axis 162 extending between the first end 154 and the second end 158, and the pivot axis 162 is generally aligned with the axis 82 of the sleeve 74 (FIG. 6). In other embodiments, the pivot axis 162 may be offset from the sleeve axis 82. The first end 154 of the hinge pin 62 includes a head or shank 170 that is coupled to the door 34 (FIG. 1) such that the pin 62 is secured against rotation relative to the door 34. The head 170 also includes a second spring coupling 174 for engaging the second end 150 of the spring member 66. In the illustrated embodiment, the second spring coupling 174 is a hole formed in the head 170 of the pin 62.

Referring again to FIG. 6, the gear shaft 70 includes a gear portion 182 and is supported for rotation within the groove 94 of the flange 78. A retaining plate 194 is coupled to the top of the flange 78 to retain the gear shaft 70 within the groove 94. The retaining plate 194 also retains the ring gear 110 and shell 58 within the sleeve 74, and retains the pin 62 within the bore 86. In one embodiment, the retaining plate 194 is formed from machined steel and is coupled to the flange 78 by fasteners (e.g., screws).

Figure 12:
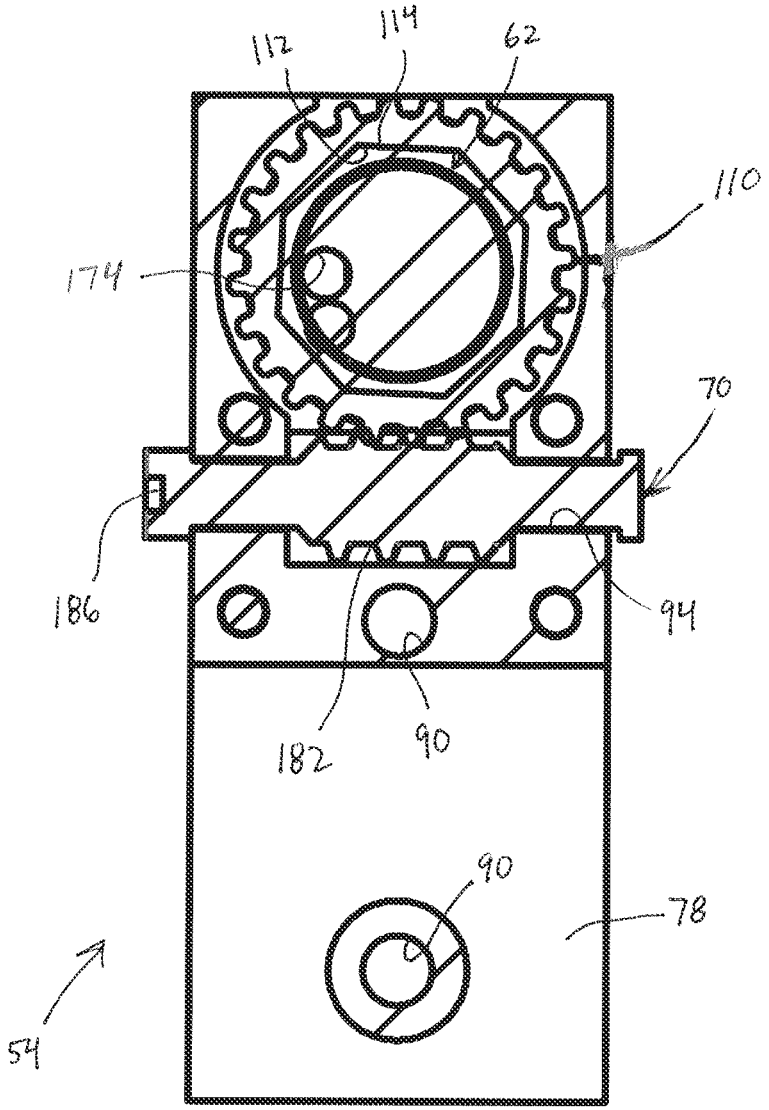
FIG. 12 is a section view of the hinge assembly of FIG. 4, taken along section 12-12.

As shown in FIG. 12, the gear portion 182 engages the ring gear 110 such that rotation of the gear shaft 70 drives the ring gear 110 and the shell 58 to pivot relative to the sleeve 74. Pivoting the shell 58 about the pivot axis 162 adjusts the pre-tension exerted on the hinge pin 62 by the spring member 66 (FIG. 11), thereby changing the biasing force exerted on the door 34. In the illustrated embodiment, the gear shaft 70 is positioned transverse to the longitudinal axis 82, and one end of the gear shaft 70 includes a slot 186 for receiving a tool (e.g., a screwdriver—not shown) for rotating the gear shaft 70 with respect to the groove 94. In this arrangement, the gear portion 182 includes a worm gear that engages the ring gear 110. The use of a worm gear allows for fine adjustment as the effective gear ratio between the worm gear and the ring gear 110 is very large. In addition, the worm gear eliminates the need for any locking mechanism to maintain the preload as the worm gear will not turn in response to a torque applied to the ring gear 110. In the illustrated embodiment, only one end of the gear shaft 70 includes the slot 186. Because the slot 186 should be accessible to a user, the slot 186 provides an indicator during installation to insure that the door closer mechanism 50 is positioned properly and to prevent a user from installing the door closer mechanism 70 backward.

Figure 5:
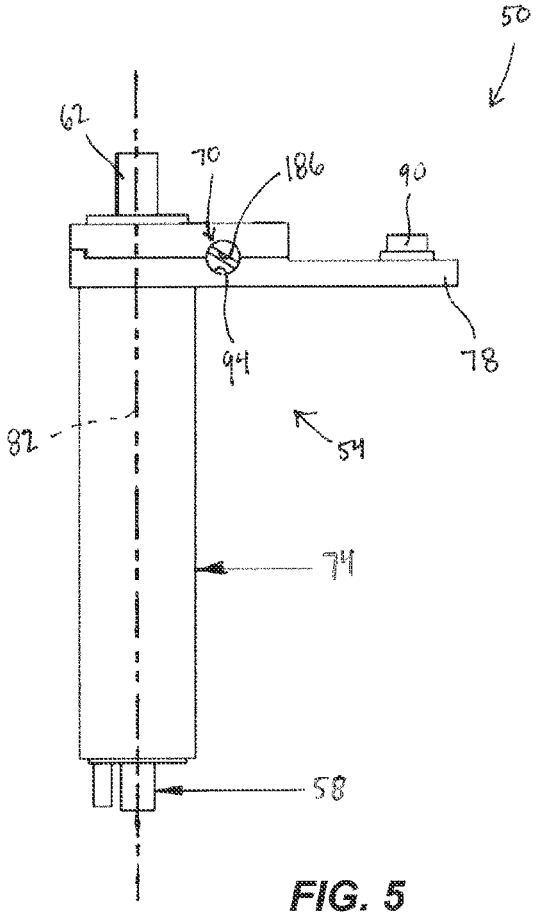
FIG. 5 is a front view of the hinge assembly of FIG. 3.

As the door 34 is opened, the hinge pin 62 pivots with respect to the shell 58 about the pivot axis 162 (FIG. 9). Because one end 150 of the spring member 66 is coupled to the hinge pin 62, the pivoting of the hinge pin 62 causes elastic deformation of the spring member 66. The spring member 66 exerts a biasing force on the hinge pin 62 and the door 64 to urge the door 64 toward the closed position, with the rotation produced during door opening increasing the biasing force. Referring to FIG. 5, the pre-tension force in the spring 66 can be adjusted by rotating the gear shaft 70 (e.g., with a screwdriver). For example, rotating the gear shaft 70 in a first direction causes the ring gear 110 and the shell 58 to pivot in a first direction about the pivot axis 162, compressing or tightening the spring member 66 and increasing the spring tension when the door 34 is in the closed position. The spring member 66 applies a larger biasing force on the hinge pin 62, requiring a larger force to open the door 34. Alternatively, rotating the gear shaft 70 in a second direction opposite the first direction causes the shell 58 to pivot in a second direction about the pivot axis 162, loosening the spring member 66 and decreasing spring tension so that the door 34 requires less force to open.

The door closer mechanism 50 provides a compact system, containing the tension-adjustment device within the sleeve 74. Some conventional door closer systems incorporate a long torque rod that must be inserted into the glass door to provide closing tension. This requires a thicker door frame to receive and house the torque rod and reduces the transparent viewable portion of the door. By contrast, the door closer mechanism 50 does not require the door 34 to accommodate a long torque rod, resulting in a thinner construction for an opaque frame of the door 34. Furthermore, some conventional door systems require more extensive dis-assembly and re-assembly to adjust the tension on a biasing member (e.g., by changing the relationship between the upper and lower spring attachment points). The door closer mechanism 50 provides a simple screw adjustment to change the pre-tension of the spring 66 without any significant disassembly of the door 34 or the door closer mechanism 50.

Thus, the invention provides, among other things, a door closer mechanism for a display case. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A hinge assembly attached to a door of a display case, the hinge assembly comprising:
- a pin for supporting the door, the pin defining a pivot axis;
- a shell including a bore receiving at least a portion of the pin, the shell being movable relative to the pin;
- a spring coupled between the pin and the shell, the spring member exerting a biasing force on the pin about the pivot axis;
- a first gear secured to the shell; and
- a second gear engaging the first gear, rotation of the second gear causing the shell to pivot relative to the pin, thereby changing the biasing force exerted by the spring member, wherein the shell, the spring, the first gear, and the second gear are disposed completely outside of the door and a portion of the pin is received by the door to facilitate movement of the door with respect to the shell.

2. The hinge assembly of claim 1, wherein the spring member is a torsional coil spring positioned within the bore around the pin, the spring including a first end secured to the shell and a second end secured to the pin.

3. The hinge assembly of claim 1, wherein the second gear is a worm gear mounted on a gear shaft defining a gear shaft axis, rotation of the gear shaft driving the first gear to rotate.

4. The hinge assembly of claim 3, wherein the gear shaft includes a slot for receiving a tool to rotate the gear shaft about the gear shaft axis.

5. The hinge assembly of claim 1, wherein the shell supports the pin for rotation relative to the shell.

6. A hinge assembly attached to a door of a display case, the door having a main housing and a closed position, the hinge assembly comprising:

a support member;

a shell including a first gear, the shell coupled to the support member;

a second gear supported for rotation by the support member and in meshing relationship with the first gear, rotation of the second gear producing a corresponding rotation of the first gear and the shell;

a pin defining a pin axis, the pin supported for rotation about the pin axis by the shell; and a biasing member connected to the pin and the shell and operable to provide a biasing force to the pin, the biasing force being adjusted in response to rotation of the shell, wherein the biasing force is configured to bias the door toward the closed position, wherein the support member, the shell, the second gear, and the biasing member are disposed completely outside of the door and a portion of the support member is received by the door to facilitate movement of the door with respect to the shell.

7. The hinge assembly of claim 6, wherein the shell and the first gear are rotatable about the pin axis, and wherein the biasing member exerts a biasing force about the pin axis.

8. The hinge assembly of claim 7, wherein the second gear is rotatable about a gear axis that is perpendicular to the pin axis.

9. The hinge assembly of claim 6, wherein the shell includes a bore receiving at least a portion of the pin, and wherein the biasing member is a torsional coil spring positioned within the bore between the shell and the pin.

10. The hinge assembly of claim 6, wherein the support member includes an elongated sleeve having a bore, and wherein the shell is positioned within the bore of the sleeve.

11. The hinge assembly of claim 6, wherein the second gear is a worm gear mounted on a gear shaft, rotation of the gear shaft driving the first gear to rotate.

12. The hinge assembly of claim 11, wherein the gear shaft includes a slot for receiving a tool to rotate the gear shaft about a gear shaft axis.

13. A hinge assembly attached to a door of a display case, the hinge assembly comprising:

a pin for supporting the door, the pin defining a pin axis;

a shell having a bottom end and a top end, the bottom end including a bore receiving at least a first portion of the pin, the shell being rotatable about the pin axis relative to the pin;

a biasing member coupled to the pin and the shell, the biasing member exerting a biasing force on the pin about the pin axis;

a first gear coupled to the top end; and a gear shaft having a second gear engaging the first gear, rotation of the second gear causing the rotation of the first gear and causing the shell to pivot relative to the pin axis to change the biasing force exerted by the biasing member, wherein the shell, the biasing member, the first gear, and the second gear are disposed completely outside of the door and a portion of the pin is received by the door to facilitate movement of the door with respect to the shell.

14. The hinge assembly of claim 13, wherein the gear shaft defines a gear shaft axis and includes a slot for receiving a tool to rotate the gear shaft about the gear shaft axis.

15. The hinge assembly of claim 14, wherein the gear shaft axis is perpendicular to the pin axis.

16. The hinge assembly of claim 14, wherein the slot is on a first end of the gear shaft, and wherein the second gear is a worm gear, the worm gear being arranged along the gear shaft axis between the slot and a second end of the gear shaft opposite the first end.

17. The hinge assembly of claim 13, wherein rotation of the gear shaft in a first direction causes the first gear and the shell to pivot in a first direction relative to the pin axis, thereby increasing the biasing force of the biasing member on the pin.

18. The hinge assembly of claim 17, wherein rotation of the gear shaft in a second direction opposite the first direction causes the first gear and the shell to pivot in a second direction relative to the pin axis, thereby decreasing the biasing force of the biasing member on the pin.

* * * * *